US006085049A

United States Patent [19]

Tanigawa

[11] Patent Number: 6,085,049

[45] Date of Patent: Jul. 4, 2000

[54] COPYING APPARATUS CAPABLE OF AUTOMATICALLY TURNING OFF AT A PREDETERMINED TIME

[75] Inventor: Tatsuya Tanigawa, Toyokawa, Japan

[73] Assignee: Minolta Co., Ltd., Osaka, Japan

[21] Appl. No.: 08/703,721

[22] Filed: Aug. 27, 1996

[30] Foreign Application Priority Data

Aug. 28, 1995 [JP] Japan ..... H 7-218821

[51] Int. Cl.[7] ..... G03G 15/00

[52] U.S. Cl. ..... 399/20; 399/88

[58] Field of Search ..... 399/20, 16, 21, 399/18, 17, 22, 37, 88

[56] References Cited

U.S. PATENT DOCUMENTS

| | | | |
|---|---|---|---|
| 4,090,787 | 5/1978 | Hubbard et al. | 399/20 |
| 4,452,525 | 6/1984 | Ogura | 399/19 |
| 4,474,454 | 10/1984 | Sugiura | 399/20 |
| 4,615,609 | 10/1986 | Honma | 399/88 |
| 4,870,526 | 9/1989 | Maruta et al. | 361/1 |
| 4,905,055 | 2/1990 | Higaki | 399/410 |
| 5,440,372 | 8/1995 | Ito et al. | 399/20 |
| 5,459,553 | 10/1995 | Kim | 399/20 |
| 5,479,240 | 12/1995 | Lee et al. | 399/21 |
| 5,678,123 | 10/1997 | Kim | 399/21 |
| 5,923,919 | 7/1999 | Nimura et al. | 399/37 |

FOREIGN PATENT DOCUMENTS

| | | |
|---|---|---|
| 59-42556 | 3/1984 | Japan . |
| 60-54008 | 3/1985 | Japan . |
| 60-142356 | 7/1985 | Japan . |
| 61-230161 | 10/1986 | Japan . |
| 62-70869 | 1/1987 | Japan . |
| 62-240974 | 10/1987 | Japan . |
| 1-134470 | 5/1989 | Japan . |
| 6-30000 | 4/1994 | Japan . |
| 8-40635 | 2/1996 | Japan . |

*Primary Examiner*—Quana Grainger
*Attorney, Agent, or Firm*—McDermott, Will & Emery

[57] ABSTRACT

A copying apparatus having a function for automatically turning off the power at a predetermined timing. The copying apparatus determines at the predetermined timing whether or not the apparatus is in an operation interrupt state in which a sheet remains inside the apparatus, so as to, if the apparatus is in the operation interrupt state, discharge the remaining sheet and then to turn off the power of the apparatus.

18 Claims, 12 Drawing Sheets

COPYING APPARATUS CAPABLE OF AUTOMATICALLY TURNING OFF AT A PREDETERMINED TIME

BACKGROUND OF THE INVENTION

1. Field of the Invention

This invention relates to a copying apparatus having a function to automatically turn off at a predetermined timing and a method to automatically turn off the power source of the copying apparatus at a predetermined timing.

2. Description of the Related Art

Eliminating wasteful electric power consumption when copies are not being taken, for instance, after working hours are over, by automatically turning off the power source of a copying apparatus at a desired timing, for example, when a presete time is reached has been proposed. For example, in the apparatus proposed in Japanese Published Patent Application Hei 6-30000, an automatic power source turn-off function that automatically turns off the power source of the copying apparatus when it has been detected that a preset time is reached as well as an automatic reset function that returns the settings of the copying apparatus to the initial settings when no operations have occurred in a predetermined time period for the operation portion of the copying apparatus have been disclosed. Another disclosure disclosed that if a timer that controls the operation of the automatic reset is counting when the time to turn off the power source by means of the automatic power source turn-off function is reached, the completion of the count will be waited for and the power source will turn off after the automatic reset is executed.

However, the above-mentioned automatic power source turn-off function does not address convenience of use considerations when the power is turned back on after automatically turning off. Namely, it is possibly assumed that the timing to turn off the power source is reached and the power source automatically turns off when, due to some reason, the copy operation of the copying apparatus is interrupted, thereby an original document remains on the original document table or a paper remains in the intermediate tray that temporarily stores paper which has been copied on one side during double-side copying. In such a case, if the original document or paper remaining on the original document table, in the intermediate tray or the like are not removed when the power source is turned on again, the copy cannot start, and therefore operational characteristics of the apparatus becomes inconvenient.

Further, in the apparatus stated in the above-mentioned Japanese Published Patent Application, if the automatic reset timer is counting at the power source turn off time, the completion of the automatic reset will be waited for and then the power source will turn off. However, when power conservation is considered, it is preferable to avoid extending the power source turn off time.

SUMMARY OF THE INVENTION

The object of the present invention is to provide a copying apparatus having an improved automatic power source turn off function and an improved method to automatically turn off the power source which eliminates the problems mentioned above.

Another object of the present invention is to improve the convenience for use when the power source is turned on again after it automatically turned off in the copying apparatus having a function to automatically turn off the power source at a predetermined timing or a method to automatically turn off the power source of the copying apparatus at a predetermined timing.

A further object of the present invention is to improve the power conservation efficiency in addition to improving the convenience for use when the power source is turned on again after it automatically turned off in the copying apparatus having a function to automatically turn off the power source at a predetermined timing or the method to automatically turn off the power source of the copying apparatus at a predetermined timing.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
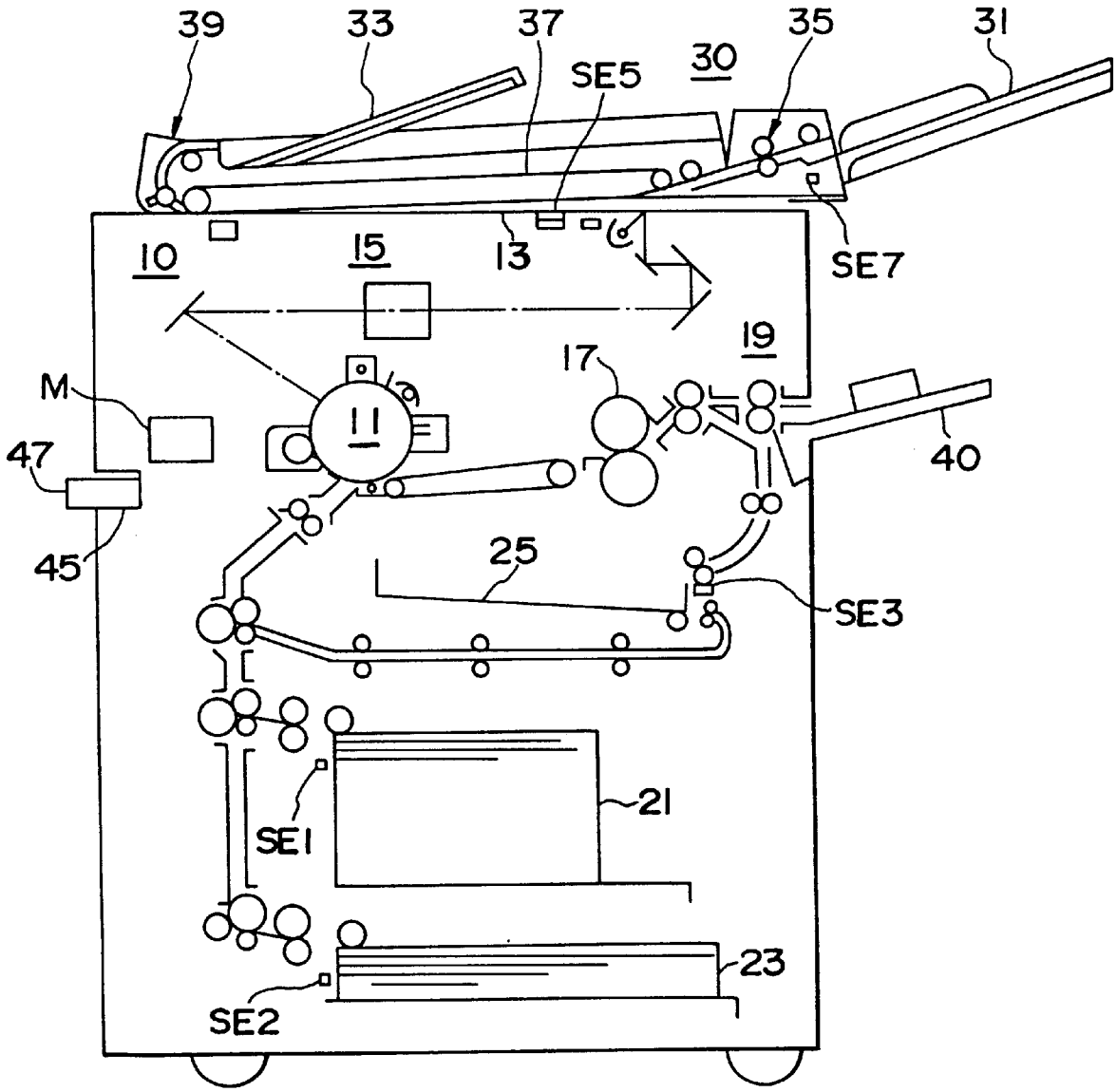
FIG. 1 is an outline of the overall construction of the apparatus of the present embodiment.

Referring now to the drawings, one preferred embodiment of the present invention will be described.

FIG. 1 shows an outline of the overall construction of the copying apparatus related to the present invention. This copying apparatus is comprised by a copying apparatus main body 10, and an automatic document feeder (ADF) 30 that transports an original document onto an original document table 13 of said copying apparatus main body 10 and sends out the original document from the table 13. The above-mentioned copying apparatus main body 10 and ADF 30 are controlled to be related to each other.

The copying apparatus main body 10 is an apparatus that forms an image utilizing an electrophotographic format and has an original document table 13 onto which is set an original document. An original document table sensor SE5 that detects whether an original document has been set on the original document table 13 and a scanning optical system 15 that exposes and scans the original document set on the original document table are both arranged under the original document table 13. An image forming portion 11 is arranged under the scanning optical system 15. Here, a photoreceptor drum is arranged at the position where the light reflected from the exposed and scanned original document forms an image and around this drum well-known devices such as a charging device, a developing device and a transfer device are arranged in this order. A fixing device 17 that thermally fixes a toner image transferred onto a paper by means of the transfer device is further provided on the downstream side of the paper feed direction.

At the lower portion of the copying apparatus main body 10 an upper paper feeding tray 21 and a lower paper feeding tray 23 are provided with paper being supplied from either of the two trays. On the upper paper feeding tray 21 a sensor SE1 that detects a paper feed and a paper empty in this tray is provided and on the lower paper feeding tray 23 a sensor SE2 that detects a paper feed and a paper empty in this tray is provided. A paper feed path comprising a pair of feed rollers and a guide which feed paper supplied from each feeding tray to the image forming portion 11 is provided. Further, a intermediate tray 25 is provided between the upper paper feeding tray 21 and the image forming portion 11. This intermediate tray is an intermediate storage member used when an image has been formed on one side of the paper supplied from either paper feeding tray 21 or 23, therefore the paper is once again supplied to the image forming portion 11 and an image is formed on the surface of that paper opposite to the first image to be formed, in other words, during double-sided copying. Another sensor SE3 that detects whether or not there is paper inside the intermediate tray 25 and if paper has been supplied from the intermediate tray 25 is provided close to the intermediate tray 25. A switching mechanism 19 that either delivers paper on which an image was formed to a delivery tray 40 or feeds the paper to the intermediate tray 25 in order to form an image again is provided on the downstream side of the paper feed direction of the fixing device 17.

A counter opening 45 is provided on the side face of the copying apparatus main body 10 at the left side of the figure and a decrementing insertable and removable counter 47 is inserted into this opening. The counter 47 is a counter that controls a function to allow only a predetermined number of copies to be taken and to stop the copy operation if the accumulated number of copies exceeds this number. The predetermined allowable number of copies is set in the counter 47 and decreases by 1 each time a copy is taken in the copying apparatus 10. Then, when the counter 47 completes the count (counter value becomes 0), the copy operation is stopped.

The ADF 30 has an original document tray 31 in which original documents are loaded, a sensor SE7 that detects whether or not an original document has been loaded into the original document tray 31, a feed unit 35 that separates and feeds original documents loaded in the original document tray 31 one sheet at a time to the original document table 13, an original document feed belt 37 that feeds and stops original documents which have been fed onto the original document table 13, a delivery unit 39 that delivers original documents in combination with the original document feed belt 37, and an original document delivery tray 33 onto which original documents are delivered.

Figure 2:
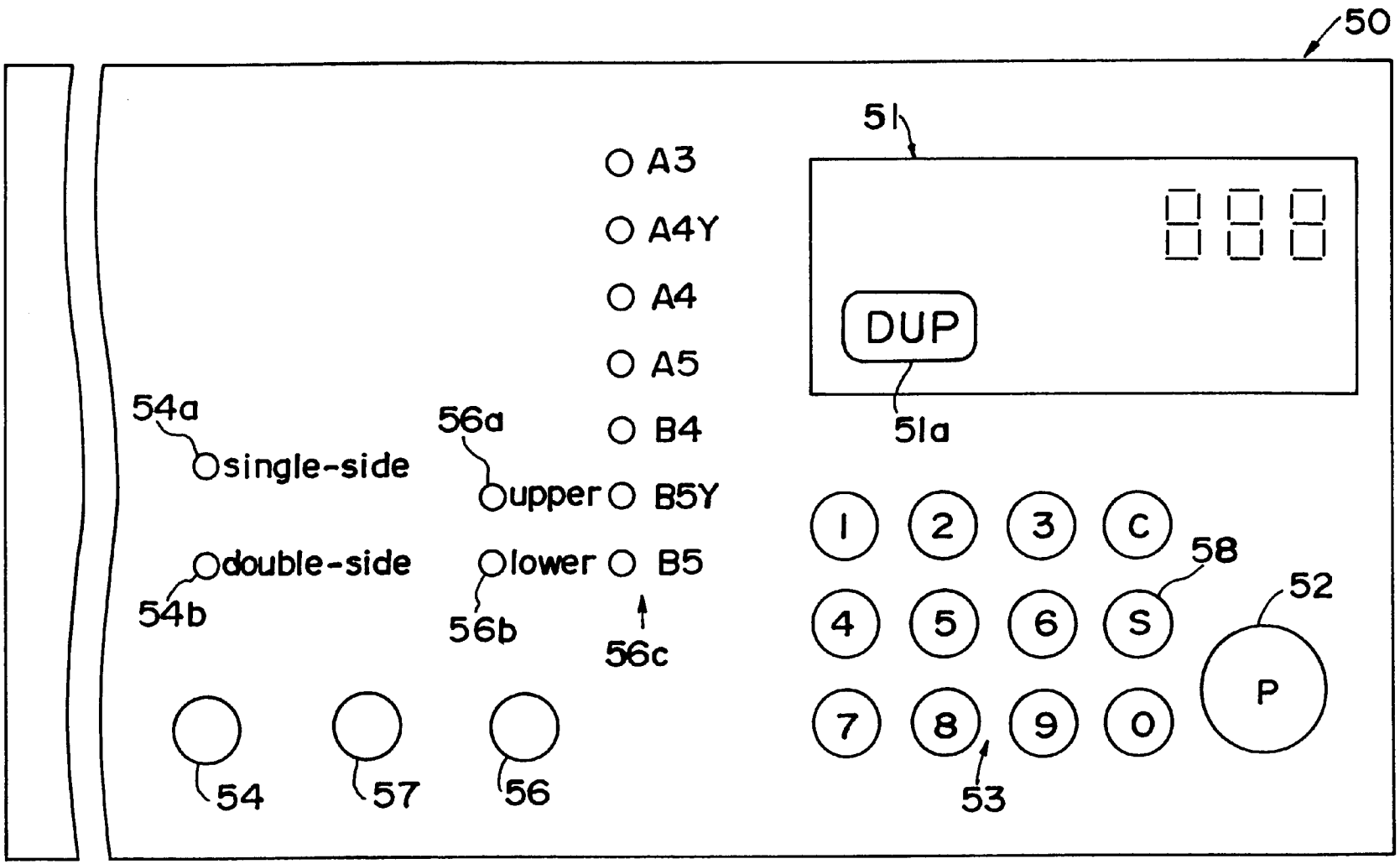
FIG. 2 shows the operation panel of the apparatus of this embodiment.

FIG. 2 shows an operation panel 50 that is provided on the top portion at the front of the copying apparatus of this embodiment. On this panel are provided a display monitor 51 that displays various messages, the number of copies set or the like, a print key 52 for the copy start command, and a ten-key unit 53 for inputting numeric values such as the number of copies. In addition, a copy mode key 54 that selects either a single-side copy mode or a double-side copy mode is provided. This copy mode key 54 is a toggle key and every time the key is pressed, the mode is switched between single-side copy mode and double-side copy mode. When the single-side copy mode is selected, only one side of the paper will be copied. Conversely, when the double-side copy mode is selected, both sides of the paper will be copied. In order to display which mode has been selected using the copy mode key 54, a single-side mode display element 54*a* that shows the single-side copy mode is selected and a double-side mode display element 54*b* that shows the double-side copy mode is selected are provided. A paper feed opening selection key 56 that selects the paper feeding tray is further provided. In like manner to the copy mode key 54, pressing this key switches in turn between the upper paper feed opening selection that supplies paper from the upper paper feeding tray 21 and the lower paper feed opening selection that supplies paper from the lower paper feeding tray 23. In order to display which paper feeding tray has been selected using the paper feed opening selection key 56, an upper opening display element 56*a* that shows the upper paper feeding tray 21 is selected and a lower opening display element 56*b* that shows the lower paper feeding tray 23 is selected are provided. In addition, a display element 56*c* that shows the size of the paper stored in the selected paper feeding tray is provided. A turn off time setting key 57 for setting the time when the power source will automatically turn off and a stop key 58 for stopping a series of copy operations are also provided.

Figure 3:
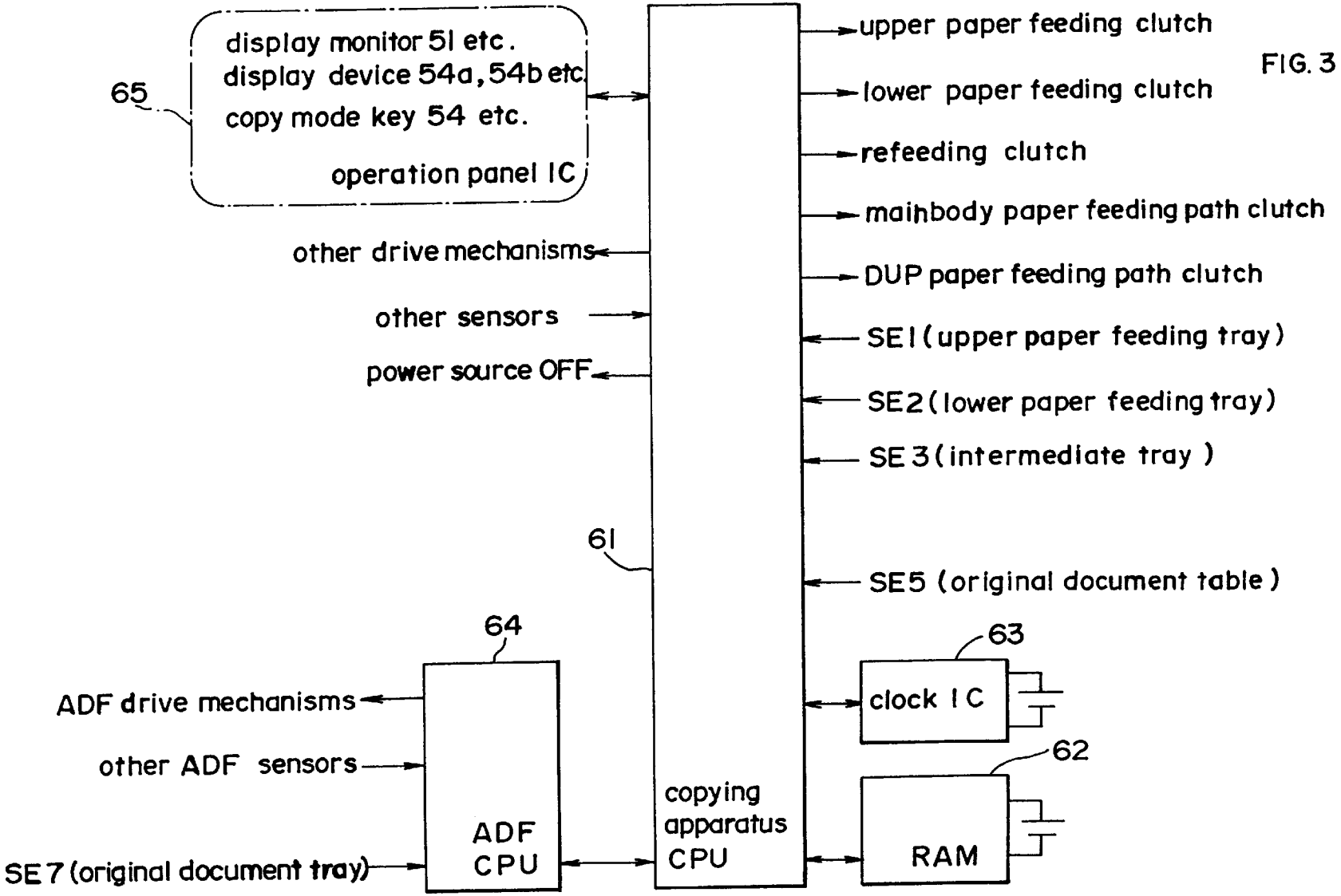
FIG. 3 shows the control system of the apparatus of this embodiment.

FIG. 3 shows the control system of the copying apparatus of this embodiment. The main part of the control system is a copying apparatus CPU 61 that controls the entire copying apparatus. Connected to the CPU 61 are an operation panel IC 65 that governs the input from the operation panel 50 and the display on the panel 50, an ADFCPU 64 that controls the ADF 30, a clock IC 63 that is backed up by its own power source and counts time and then outputs the time data, a non-volatile memory RAM 62 that is backed up by its own power source and stores the time set by means of the time setting key 57, etc., in addition to the various sensors and each drive mechanism provided on the copying apparatus main body.

Next, the operation of the copying apparatus of this embodiment will be simply described.

If we assume the settings are such that five copies will be taken in the double-side copy mode, by pressing the print key 52, the sensor SE7 will detect whether or not an original document has been loaded in the original document tray 31 of the ADF 30. If the sensor detects that an original document is loaded in the tray, the feed unit 35 is driven and the original documents which are separated into single sheets are fed onto the original document table 13 and set at a predetermined position.

The original document that was set onto the original document table 13 is exposed and scanned by the scanning optical system 15. By means of this operation, the slit-shaped light reflected from the original document is formed into an image on the photoreceptor drum that was uniformly charged by the charging device at the image forming portion 11 and an electrostatic latent image corresponding to the light reflected from the original document is then formed on the photoreceptor drum. This electrostatic latent image becomes visible by means of toner when it reaches the position facing the developing device by the rotation of the photoreceptor drum and then the visible image (toner image)

is transferred to the first side of the paper fed from the paper feeding tray selected by means of the operation panel 50. The transfer image on the paper is fed to the fixing device 17 and then fixed on the paper. Thereafter the paper that completed the copy on the first side is sent to the intermediate tray 25. Continuing, next paper is supplied from the paper feeding tray and, in like manner to the above procedure, the copy on the first side is continuously carried out and five sheets of paper copied on these first sides are stored in the intermediate tray 25.

When the copy operation of the first side of all five sheets of paper is complete, the original document feed belt 37 and the delivery unit 39 are driven, the original document on the original document table 13 is delivered to the original document delivery tray 33 and the next original document is fed to and set on the original document table 13 from the original document tray 31 by means of the feed unit 35.

Then, in like manner to the procedure above, a toner image is formed on the photoreceptor and the paper to be supplied in order from the intermediate tray 25 that completed the copy on the first side undergoes copying on its second side. The paper that completed the copy on both sides is then delivered to the delivery tray 40.

FIGS. 4 to 12 are flowcharts showing the sequence of the processes executed by the copying apparatus CPU 61.

Figure 4:
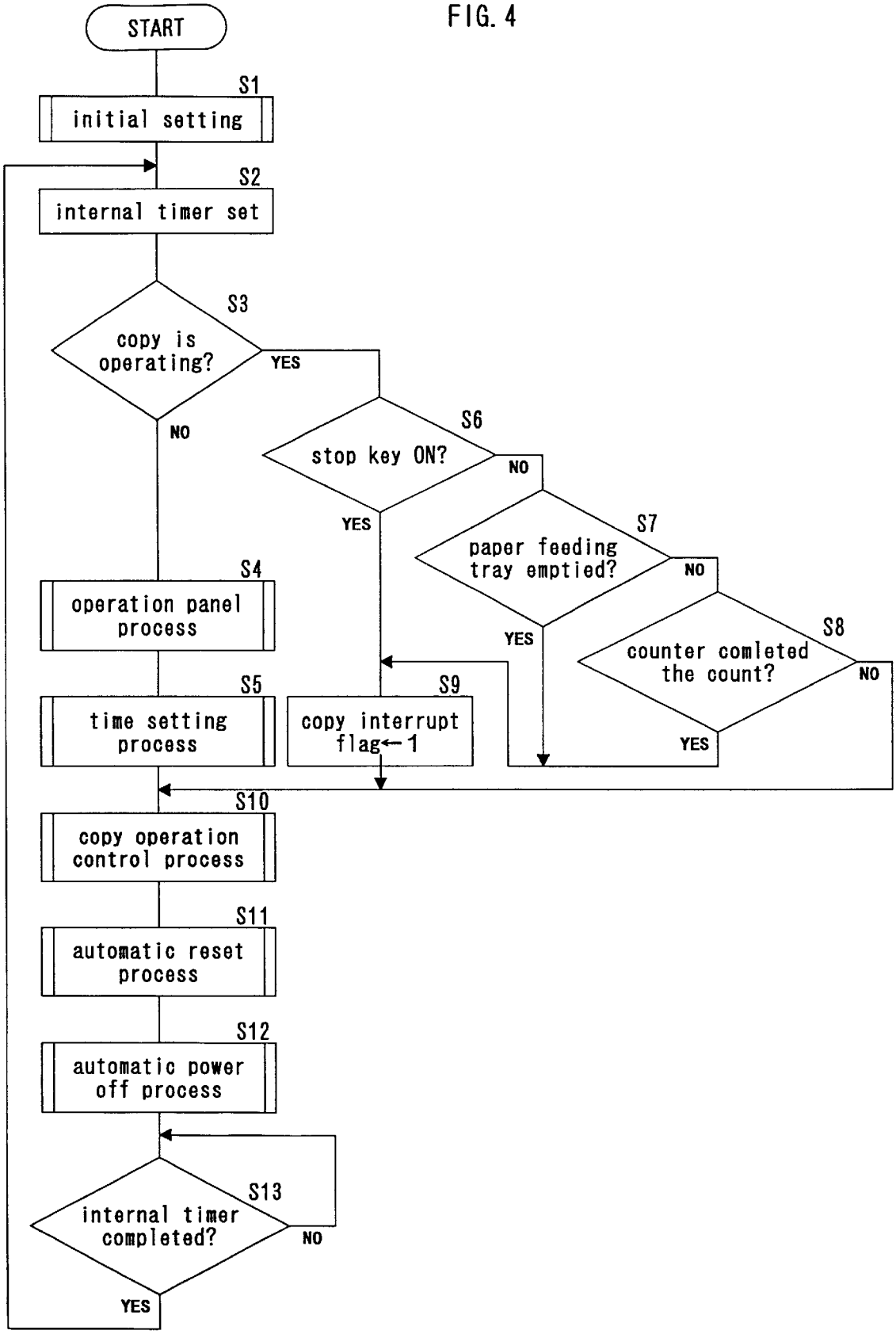
FIG. 4 is a flowchart showing the main routine of the process that controls the operation of the apparatus of this embodiment.
Figure 5:
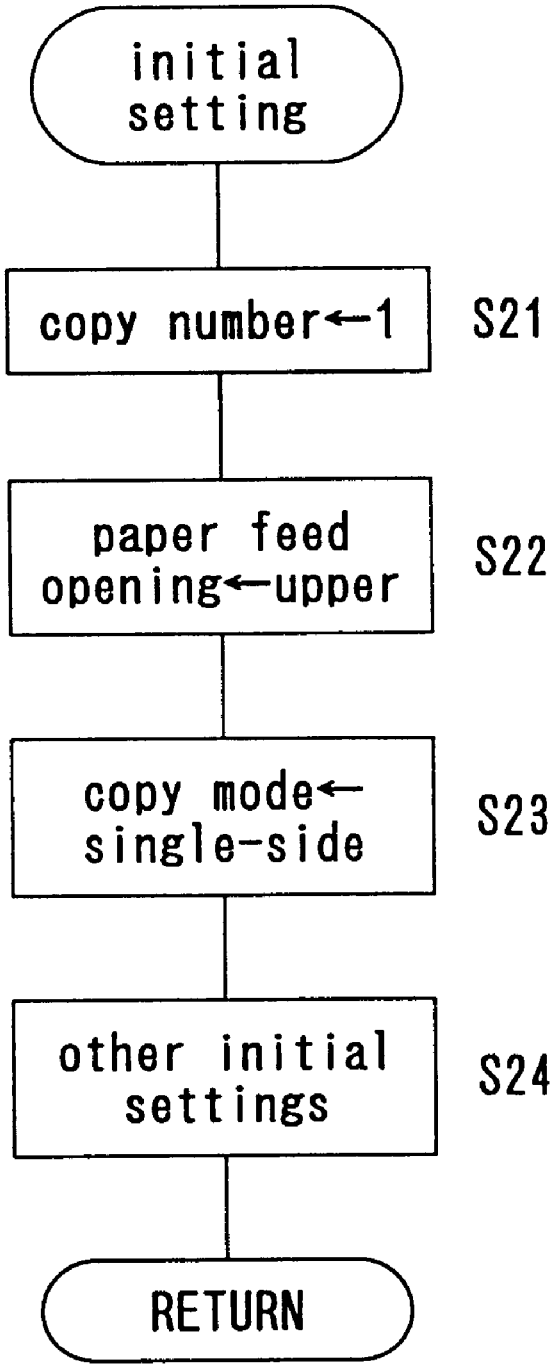
FIG. 5 is a flowchart showing the initial setting process subroutine.

FIG. 4 s hows an outline of the overall composition of the processing of the copying apparatus CPU 61. When th e power source of the copying apparatus is turned on a nd the program starts, at first, in step S1 a subroutine executes to perform initial settings of the copying apparatus. As shown in FIG. 5, this initial setting subroutine sets the number of copies to 1, the paper feed opening to the upper paper feeding tray 21 and the copy mode to the single-side copy mode (S21, S22, S23) in addition to performing other settings including magnification to a predetermined state (S24) In step S2, the internal timer of the CPU 61 is set.

Next, in step S3 a judgment is made on whether or not the copy operation is operating and, if it is not operating, the process proceeds to step S4 and S5 and the operation panel process routine and time setting process routine execute. The operation panel process routine and time setting process routine are described in detail later.

On the other hand, in step S3, if the judgment determines copy operation is operating, the process proceeds to step S6 and a judgment is made on whether or not the stop key 58 has been turned on.

When the stop key 58 has not been pressed, the process proceeds to step S7 and a confirmation is made on whether or not there is paper in the selected paper feeding tray. When all the paper has not been used, namely, when there is paper in the paper feeding tray, the process proceeds to step S8 and a judgment is made on whether or not the counter 47 set in the counter opening 45 of the main body completed the count. When the counter did not complete the count, the process proceeds to step S10. If the judgement in either steps S6, S7 or S8 are YES, namely, when the stop key 58 was pressed, when all the paper in the designated paper feeding tray has been used, or when the counter 47 has completed, a judgment is made that the copying apparatus is in a copy operation interrupt state in which a paper remains inside the copying apparatus and the process proceeds to step S9. Then, the copy interrupt flag is set to 1 and the process proceeds to step S10.

From here, the copy operation control process is executed in step S10 and continuing into step S11 in which the automatic reset process is executed, thereafter the automatic power off process is executed in step S12. The routines of the copy operation control process, the automatic reset process, and the automatic power off process are described in detail later. Then, the completion of the internal timer is waited for in step S13 and one routine ends when the timer terminates.

Figure 6:
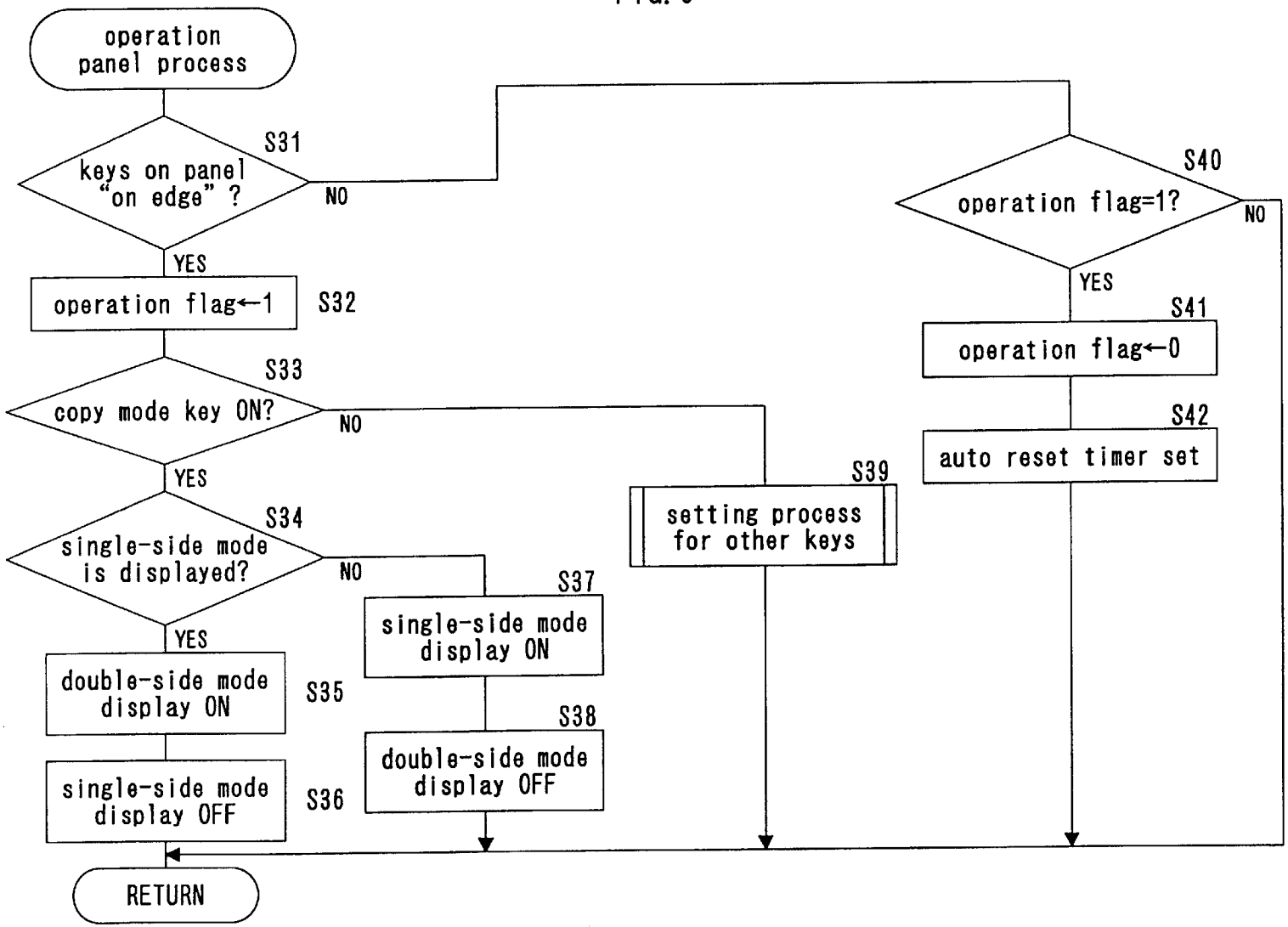
FIG. 6 is a flowchart showing the operation panel process subroutine.

FIG. 6 shows the operation panel process routine. In step S31, if any of the keys on the operation panel 50 are "on edge" (change in state from an OFF state to an ON state), the operation flag is set to 1 in step S32 and in step S33 a judgment is made on whether or not the copy mode key 54 is ON. If the copy mode key 54 is ON, the process proceeds to step S34 and a judgment is made on whether or not the single-side copy mode is displayed. If the single-side copy mode is displayed, the double-side copy mode is displayed in step S35 and the display of the single-side copy mode is turned off in step S36 with this routine ending with the copy mode changing from the single-side copy mode to the double-side copy mode. In contrast, if the single-side copy mode is not displayed in step S34, namely, if the double-side copy mode is displayed, the single-side copy mode displays in step S37, the display of the double-side copy mode is turned off in step S38 and this routine ends with the copy mode changing from the double-side copy mode to the single-side copy mode.

If NO in step S33, namely, if the copy mode key 54 has not been turned on, the process proceeds to step S39 and the setting process for other keys which have been turned on is executed.

In step S31, even if none of the keys on the operation panel 50 are on edge, the process proceeds to step S40 and a judgment is made on whether or not the operation flag is set to 1. If the operation flag is 1, the operation flag is returned to 0 in step S41 and in step S42, the automatic reset timer sets ending this routine. In step S40, if the operation flag is not 1, the routine will end without any changes.

Figure 7:
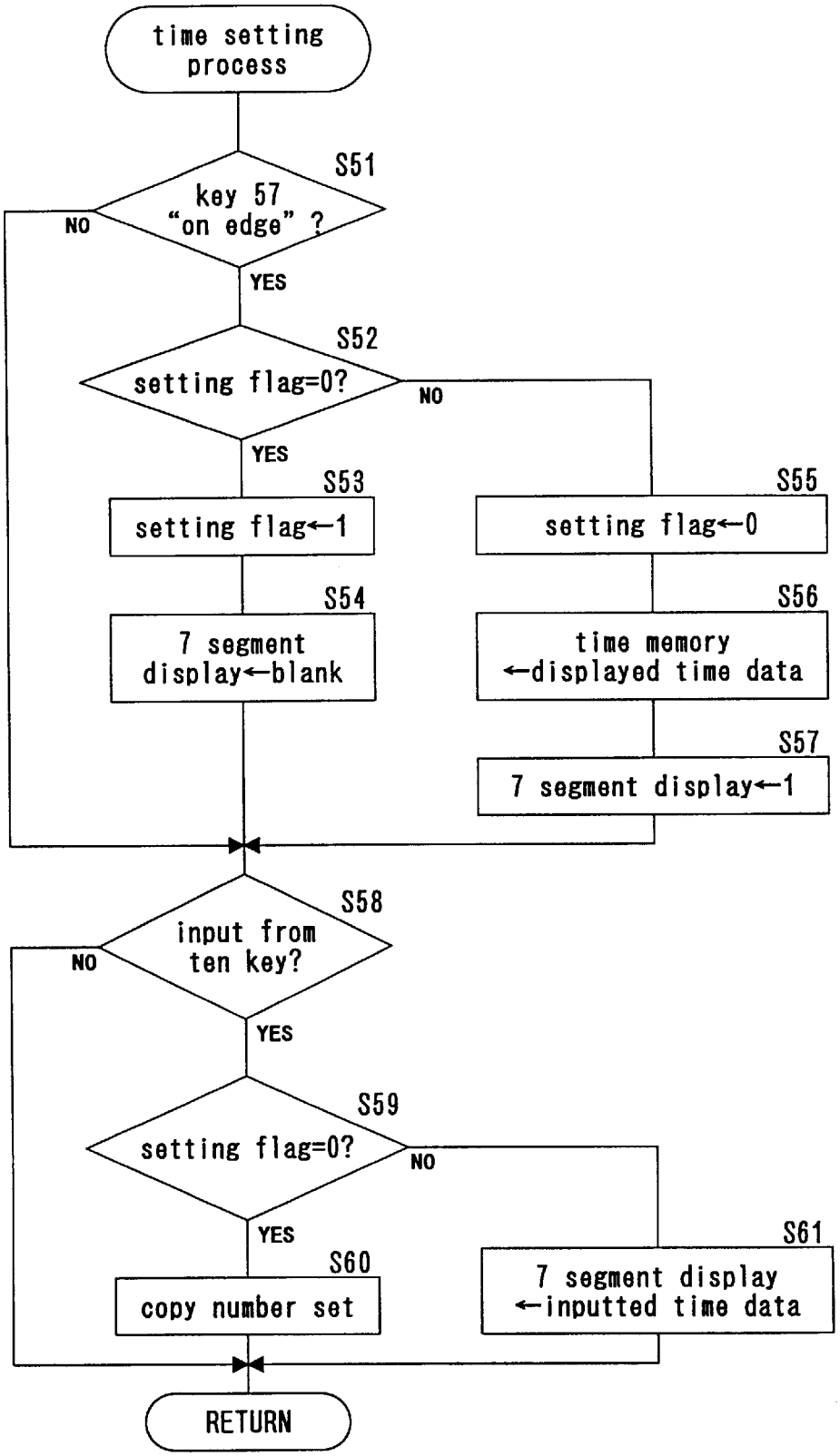
FIG. 7 is a flowchart showing the time setting process subroutine.

FIG. 7 shows the time setting process routine that sets the time to automatically turn off the power source to be executed in step S5. In step S51, a judgment is made on whether or not the power source turn off time setting key 57 is on edge. If it is not on edge, the subsequent processes will be skipped and the process proceeds to step S58. If it is on edge, in step S52, the power source turn off time setting flag is judged and if this flag is 0, the setting of the time from this point will be carried out. Thereby, in step S53, the power source turn off time setting flag is set to 1 and in step S54, the seven segment LED display of the numeric display device 51 goes blank. Further, in step S52, when the judgment determines the power source turn off time setting flag is 1, the setting of the time will be determined to be already completed. Thereby, in step S55, the power source turn off time setting flag is set to 0 and in step S56, the time data displayed in the numeric display device 72 is stored in the memory of the RAM 62 (FIG. 3). Then, in step S57, the display monitor 51 is returned to the display indicating the number of copies and displays 1. Next, in step S58, a judgment is made on whether or not there is any input from the ten-key unit 53 (FIG. 2). If there is input from the ten-key unit 53, in step S59, the power source turn off time setting flag is judged and if that flag is not 0, the time data of the power source turn off input by the ten-key is displayed in the display monitor 51 in step S61. When the power source turn off time setting flag is 0, the data indicating the number of copies input by the ten-key is displayed and set in step S60.

Figure 8:
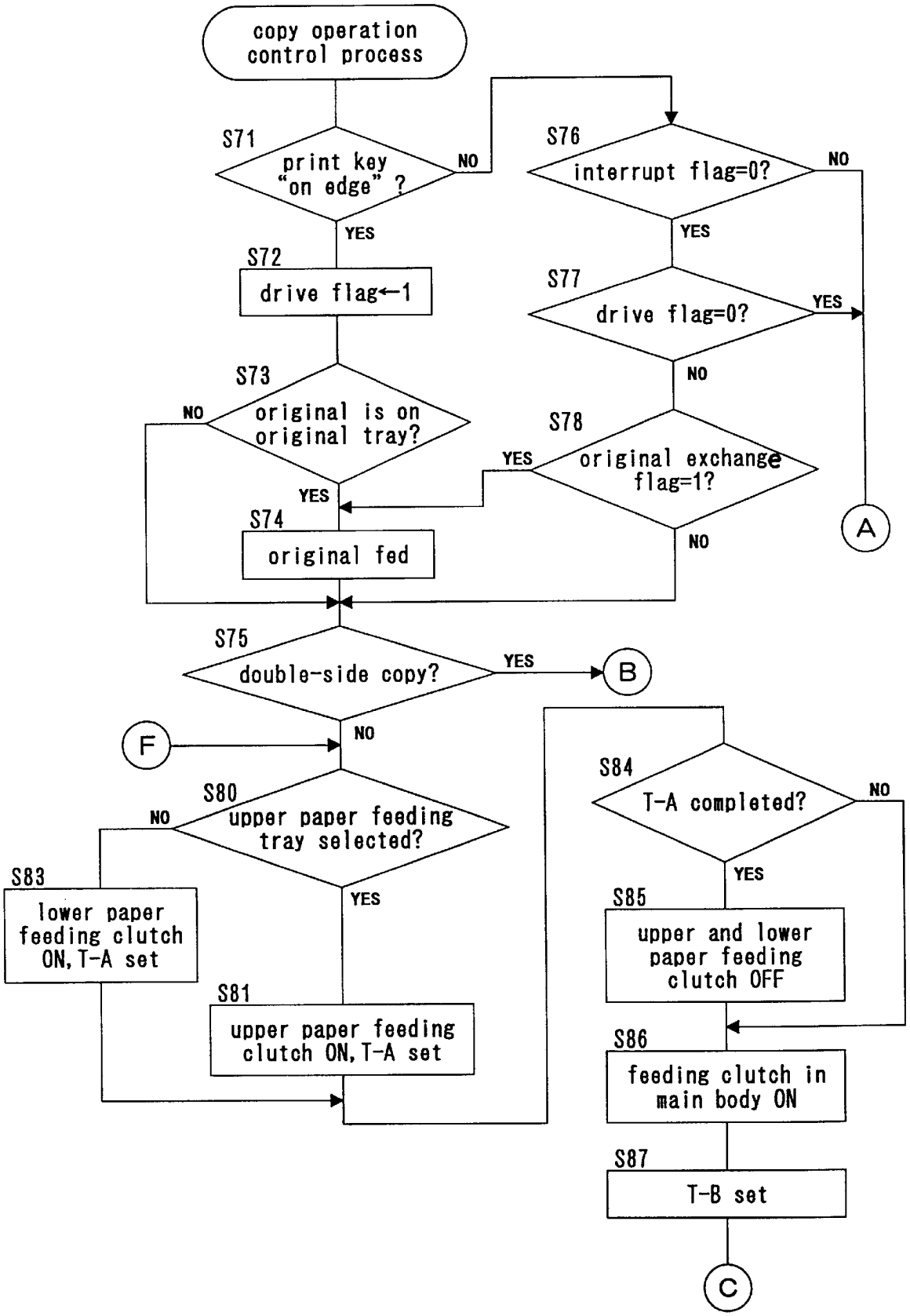
FIG. 8 is a flowchart showing the copy operation control process subroutine.
Figure 9:
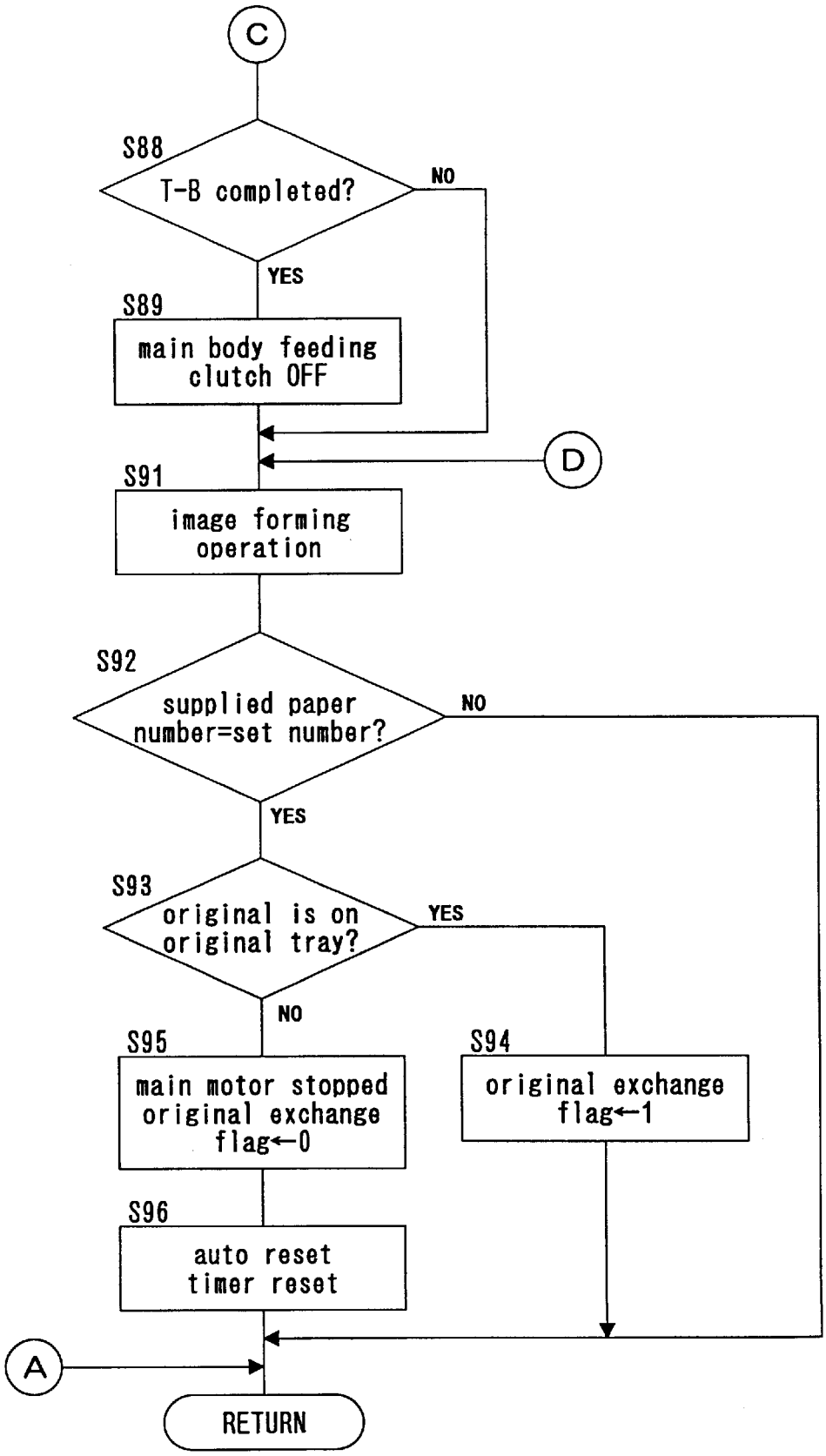
FIG. 9 is a flowchart showing the copy operation control process subroutine.
Figure 10:
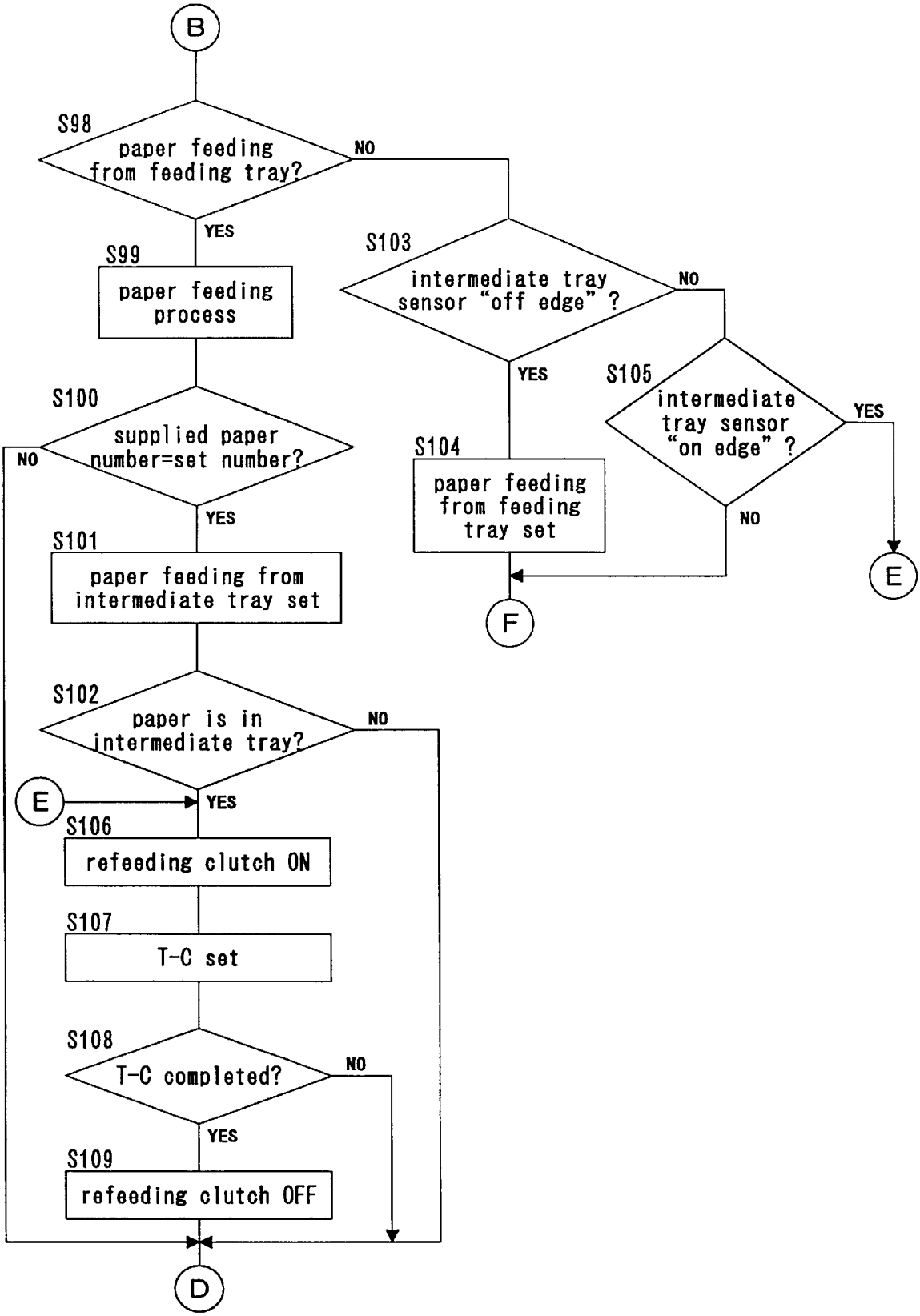
FIG. 10 is a flowchart showing the copy operation control process subroutine.

The flowcharts in FIGS. 8, 9 and 10 show the copy operation control process which controls the copy operation of the copying apparatus executed in step In step S71, a judgment is made on whether or not the print key 52 is on edge. If it is on edge, in step S72, the drive flag of main motor M that drives the photoreceptor drum and other devices is set to 1 and main motor M is made to drive and then in step S73, a judgment is made from the output of the sensor SE7 on whether or not there is an original document in the original document tray 31. If there is an original document in the tray, the process proceeds to step S74 and the ADF 30 is driven sending the original document to the original document table 13, and then the process proceeds to step S75. If there is no original document, step S74 is skipped and the process proceeds to step S75.

In step S71, if the print key 52 is not on edge, the process proceeds to step S76 and a judgment is made on whether or not the interrupt flag is 0. If the flag is not 0, or in other words, the copy operation is interrupted, and therefore, the copy operation will not be executed and this routine will end. If the flag is 0, in step S77, a judgment is made on whether or not the main motor M is operating and if it is not operating (S77=YES), this routine will end. If the motor is operating (S77=NO), the process proceeds to step S78 and a judgment is made on whether or not the original document exchange flag is 1. If the flag is 1, the process proceeds to step S74 and the next original document is fed. If the flag is not 1, the process proceeds to step S75.

In step S75, a judgment is made on whether or not the copy mode is the double-side copy mode. If the mode is the double-side copy mode, the process proceeds to step S98. If the mode is not the double-side copy mode, the process proceeds to step S80. In step S80, a judgment is made on whether the upper paper feeding tray 21 or the lower paper feeding tray 23 is selected. If the upper paper feeding tray 21 is selected (S80=YES), in step S81, the upper paper feeding clutch is turned on along with the control timer T-A starting (paper feeding from the upper paper feeding tray 21) and if the lower paper feeding tray 23 is selected (S80=NO), in step S83, the lower paper feeding clutch is turned on along with the control timer T-A starting (paper feeding from the lower paper feeding tray 23). In step S84, when the end of the timer T-A is detected, the paper feeding clutch is turned off in step S85 and the counter 47 is increased. Next, in step S86, the feed clutch of the copying apparatus main body is turned on along with the timer T-B setting in step S87. In step S88, a judgment is made on whether or not the timer T-B completed its count and in step S89, the feed clutch of the main body is turned off.

In step S91, the scanner 15, the photoreceptor drum of the image forming portion 11 and their peripheral devices are driven to carry out a well-known image forming operation with the toner image being transferred and fixed to the paper that was fed. In step S92, a judgment is made on whether or not the quantity of paper supplied matches the number of copies set by the ten-key unit 53. If there is no match (S92=NO), namely, if the predetermined number of copies is not reached, this routine ends. If the quantity of paper supplied reaches the quantity of copies set (S92=YES), in step S93, a judgment is made on whether or not there is an original document in the original document tray 31. If there is an original document in the original document tray 31, in step S94, the original document exchange flag is set to 1. If there is not an original document in the original document tray 31, in step S95, the main motor M is stopped and the original document exchange flag is set to 0 and, in step S96, the automatic reset timer that was set by the operation panel process routine is reset and this routine ends.

In step S75, if the judgment determines the mode is the double-side copy mode (S75=YES), in step S98, a judgment is made on whether or not the paper feed opening is either the upper paper feeding tray 21 or the lower paper feeding tray 23 on the main body side. If paper feeding from either of the above-mentioned paper feeding trays is set (S98=YES), in step S99, the paper feeding process is carried out in like manner to steps S80 to S89 previously described. Continuing, in step S100, a judgment is made on whether or not the quantity of paper supplied matches the number of copies set by the ten-key unit 53. If there is no match, namely, if the desired number of copies is not reached (S100=NO), the process proceeds to step S91. If the quantity of paper supplied reaches the number of copies set (S100=YES), the process proceeds to step S101 and the paper feed opening is set to the intermediate tray 25. In step S102, a judgment is made from the output of the sensor SE3 on whether or not there is paper in the intermediate tray 25. If there is no paper (S102=NO), the process proceeds to step S91. If there is paper (S102=YES), the process proceeds to step S106.

In step S98, when the judgment determines the setting is neither to the upper nor lower paper feeding trays (S98=NO), namely, when paper feeding from the intermediate tray 25 is set, in step S103, a judgment is made on whether or not the sensor SE3 is off edge or, in other words, if the paper in the intermediate tray 25 changed from an existent to a non-existent state.

If the sensor is off edge (S103=YES), the process proceeds to step S104, the paper feed opening is set to the paper feeding tray and then the process proceeds to step S80. If the sensor is not off edge (S103=NO), the process proceeds to step S105 and a judgment is made on whether or not the sensor SE3 is on edge or, in other words, if the paper in the intermediate tray 25 changed from a non-existent to an existent state. If the sensor SE3 is not on edge (S105=NO), the process proceeds to step S80 and if the sensor SE3 is on edge (S105=YES), the process proceeds to step S106.

In step S106, the clutch of a resupply roller that picks up paper from the intermediate tray 25 is turned on to supply paper and, in step S107, a timer T-C for controlling the resupply clutch is set. The completion of the above-mentioned timer T-C is waited for in step S108 and then in step S109, the resupply clutch is turned off along with the counter 47 increasing and the process proceeding to step S91.

Figure 11:
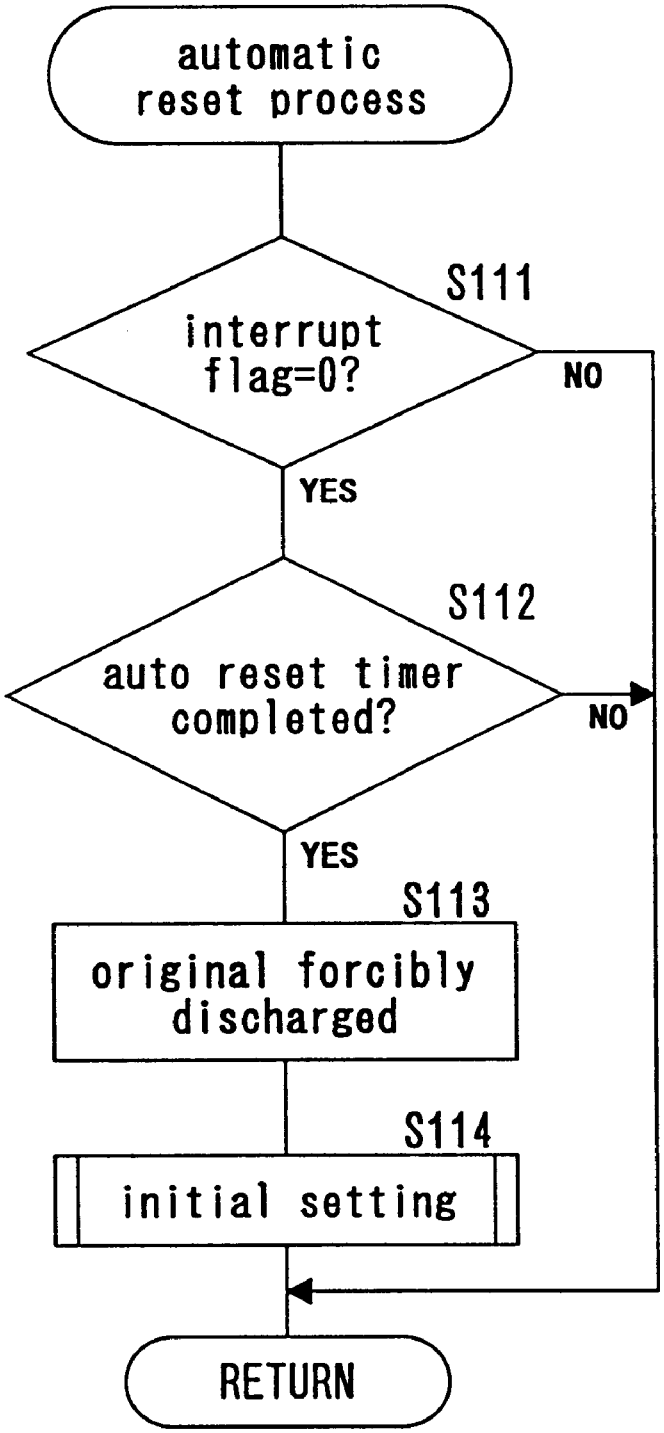
FIG. 11 is a flowchart showing the automatic reset process subroutine.

FIG. 11 shows the automatic reset process routine that is executed in step S11. The automatic reset process is a process that automatically returns each setting of the copying apparatus to the initial setting state when either the operation panel of the copying apparatus has not been operated or copy operation of the copying apparatus based on the operation has not been executed during a predetermined time period.

At first, in step S111, a judgment is made on whether or not the copy interrupt flag is ON. If the copy interrupt flag is ON (S111=NO), the process returns to the main routine without the subsequent processes executing. In other words, the automatic reset process is not executed when the copying apparatus is in a copy interrupt state. This occurs because it may be inconvenient to have initial copy conditions returned to an initial state after the operator releases the copy interrupt state. In step S111, if the copy interrupt flag is not ON (S111=YES), the process proceeds to step S112 and a judgment is made on whether or not the automatic reset timer has completed. If the timer has not completed (S112=NO), this routine ends. If the timer has completed (S112=YES), when an original document has been forgotten on the original document table 13 in step S113, the original document is forcibly discharged and thereafter, in step S114, the settings of the copying apparatus are returned to the initial setting state. This routine for the initial settings is identical to the initial setting routine described above and shown in FIG. 5.

Figure 12:
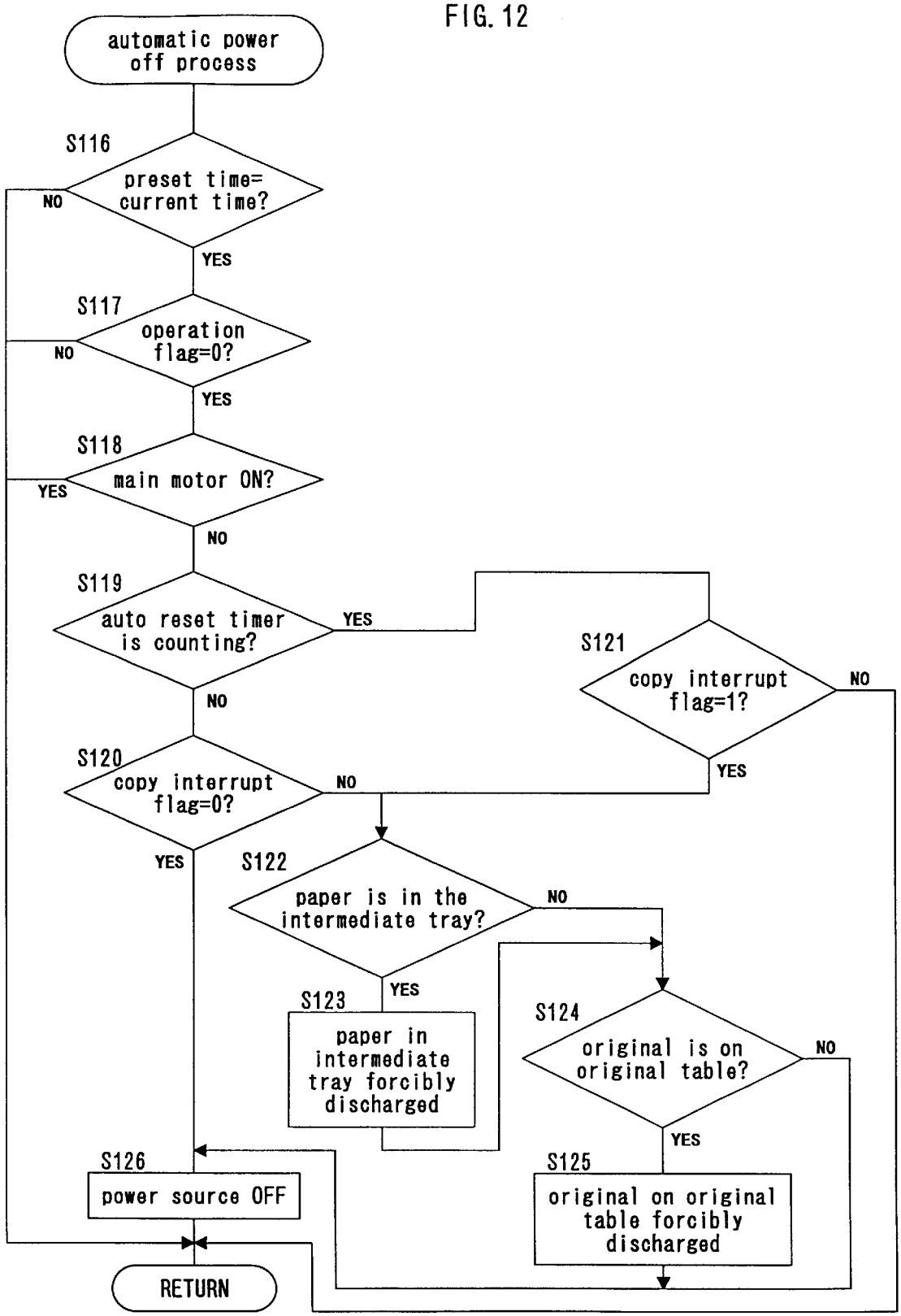
FIG. 12 is a flowchart showing the automatic power source turn off process subroutine.

FIG. 12 shows the automatic power source turn off process routine executed in step S12. The automatic power source turn off process is a process to automatically turn off the power source when a preset time is reached. If the copying apparatus is in a copy interrupt state at this moment, the sheets remaining inside the copying apparatus (including original documents on the original document table 13 and paper inside the intermediate tray 25) are forcibly discharged and then the power source turns off.

At first, in step S116, when the current time counted by the clock IC 63 and the power source turn off set time stored in the RAM 62 match (power source turn off time is reached) (S116=YES), in steps S117 and S118, the states of the operation flag and the main motor are checked and if the operation panel 50 is operating or the copying apparatus is copying (S117=NO or S118=YES), the completion of these is waited for and the process proceeds to step S119.

In step S119, if the automatic reset timer is counting, the process proceeds to step S121 and the state of the copy interrupt flag is judged. Hereupon, if the copying apparatus is not in a copy interrupt state (S121=NO), the process returns to the main routine of FIG. 4 and the completion of the automatic reset process is waited for (S119). Thereafter, in step S126, the power source of the copying apparatus turns off and the process ends.

In step S120 or step S121, when the copy interrupt flag is ON (S120=NO, S121=YES), namely, the copying apparatus is in a copy interrupt state, the process proceeds to step S122 and the inside of the intermediate tray 25 and the top of the original document table 13 are checked for any remaining paper or original documents (S122, S124). If there is any remaining paper or original documents (S122=YES and/or S125=YES), in step S123 or step S125, a pick-up roller (not shown in figure) provided close to the intermediate tray 25 or the original document feed belt 37 are driven to forcibly discharge the paper or original document. Thereafter, in step S126, the power source of the copying apparatus turns off and this process ends.

Specifically, when the copying apparatus of this embodiment is in the copy interrupt state at the set time for the automatic power source turn off, regardless of whether or not the automatic reset timer is currently counting, any paper or original documents remaining inside the intermediate tray 25 or on the original document table 13 are forcibly discharged and the power source is immediately turned off. In contrast to this, when the copying apparatus is not in the copy interrupt state at the set time for the automatic power source turn off, if the automatic reset timer is not currently counting, the power source will immediately turn off, and if the timer is currently counting, the completion of the automatic reset process will be waited for and the power source will then turn off.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

For instance, in this embodiment, it is shown that the automatic power source turn off is a function in which a set time is input with the power source automatically turning off when the set time that was input is reached. However, in like manner to the automatic reset timer, after operating the operation panel 50 or after the copy operation of the copying apparatus completes, a timer is made to start and by either previously setting a fixed time longer than the automatic reset, for example, from 30 minutes to 2 hours, or inputting a desired time, the power source can be turned off at the moment either of these times elapsed.

What is claimed is:

1. A copying apparatus comprising:

automatic turn off means for automatically turning off the power source of the copying apparatus at a predetermined timing;

judgment means for determining whether the copying apparatus is in an operation interrupt state in which a sheet remains inside the copying apparatus;

sheet discharge means for forcibly discharging said remaining sheet; and control means for having said remaining sheet discharged by the sheet discharge means and then turning off the power source of the copying apparatus when the judgment means determines an operation interrupt state of the copying apparatus exists at said predetermined timing.

2. The copying apparatus as claimed in claim 1, wherein said operation interrupt state is a state in which the copying apparatus is stopped by pressing the stop key to interrupt the copy operation of the copying apparatus.

3. The copying apparatus as claimed in claim 1, wherein said operation interrupt state is a state in which the copying apparatus is stopped because the paper has been all used during the copy operation of the copying apparatus.

4. The copying apparatus as claimed in claim 1, wherein said automatic turn off means turns off the power source of the copying apparatus at a preset time.

5. The copying apparatus of claim 1, wherein said sheet discharge means discharges original document on original document table of the copying apparatus.

6. The copying apparatus of claim 1, wherein said sheet discharge means discharges paper in an intermediate tray of the copying apparatus, which tray temporarily stores the paper copied on one side thereof during double-sided copying.

7. A copying apparatus comprising:

automatic turn off means for automatically turning off the power source of the copying apparatus at a predetermined timing;

judgment means for determining whether the copying apparatus is in an operation interrupt state in which a sheet remains inside the copying apparatus;

sheet discharge means for forcibly discharging said remaining sheet, wherein said sheet discharge means discharges original document on original document table of the copying apparatus and paper in intermediate tray of the copying apparatus, which tray temporarily stores the paper copied on one side thereof during double-side copying; and control means for having said remaining sheet discharged by the sheet discharge means and then turning off the power source of the copying apparatus when the judgment means determines an operation interrupt state of the copying apparatus exists at said predetermined timing.

8. A copying apparatus comprising:

automatic turn off means for automatically turning off the power source of the copying apparatus at a predetermined timing;

reset means for returning the settings of the copying apparatus to an initial setting when no operation for the copying apparatus has been performed during a predetermined time period and no copy operation of the copying apparatus has occurred during the predetermined time period;

timing means for starting to time the predetermined time period in response to the completion of the operation for the copying apparatus or the copy operation of the copying apparatus;

judgment means for determining whether the copying apparatus is in an operation interrupt state in which a sheet remains inside the copying apparatus;

sheet discharge means for forcibly discharging said remaining sheet; and control means for (1) when the judgment means determines an operation interrupt state of the copying apparatus exists at said predetermined timing, having said remaining sheet discharged by the sheet discharge means and then turning off the power source of the copying apparatus immediately regardless of whether or not the timing means is currently counting, and (2) when the judgment means determines an operation interrupt state of the copying apparatus does not exist and the timing means is currently counting at said predetermined timing, turning off the power source of the copying apparatus after the completion of the reset means operation.

9. The copying apparatus as claimed in claim 8, wherein said control means turns off the power source of the copying apparatus immediately when the judgment means determines an operation interrupt state of the copying apparatus does not exist and the timing means is not currently counting at said predetermined timing.

10. The copying apparatus as claimed in claim 8, wherein said operation interrupt state is a state in which the copying apparatus is stopped by pressing the stop key to interrupt the copy operation of the copying apparatus.

11. The copying apparatus as claimed in claim 8, wherein said operation interrupt state is a state in which the copying apparatus is stopped because the paper has been all used during the copy operation of the copying apparatus.

12. The copying apparatus as claimed in claim 8, wherein said sheet discharge means discharges original document on original document table of the copying apparatus and paper in intermediate tray of the copying apparatus, which tray temporarily stores the paper copied on one side thereof during double-side copying.

13. The copying apparatus as claimed in claim 8, wherein said automatic turn off means turns off the power source of the copying apparatus at a preset time.

14. The copying apparatus of claim 8, wherein said sheet discharge means discharges original document on original document table of the copying apparatus.

15. The copying apparatus of claim 8, wherein said sheet discharge means discharges paper in an intermediate tray of the copying apparatus, which tray temporarily stores the paper copied on one side thereof during double-sided copying.

16. A method for automatically turning off a power source of a copying apparatus comprising:

a first step for setting a timing to automatically turn off the power source of the copying apparatus;

a second step for determining whether the copying apparatus is in an operation interrupt state in which a sheet remains inside the copying apparatus when the timing set in the first step is reached; and a third step for discharging said remaining sheet and then turning off the power source of the copying apparatus when an operation interrupt state of the copying apparatus is determined in the second step.

17. The method of claim 16, wherein said copying apparatus has an automatic reset function which returns the settings of the copying apparatus to an initial setting when no operation for the copying apparatus has been performed during a predetermined time period and no copy operation of the copying apparatus has occurred during the predetermined time period, and wherein said third step includes a step (a) for discharging said remaining sheet and then turning off the power source of the copying apparatus immediately regardless of whether or not the timing means to operate the automatic reset function is currently counting when the judgment result in the second step determines an operation interrupt state of the copying apparatus exists and a step (b) for turning off the power source of the copying apparatus after the completion of the automatic reset operation when the judgment result in the second step determines an operation interrupt state of the copying apparatus does not exist and the timing means is currently counting.

18. A method for automatically turning off a power source of a copying apparatus having an automatic reset function that returns the settings of the copying apparatus to an initial setting when no operation for the copying apparatus has been performed during a predetermined time period and no copy operation of the copying apparatus has occurred during the predetermined time period, the method comprising:

a first step for setting a timing to automatically turn off the power source of the copying apparatus;

a second step for determining whether the copying apparatus is in an operation interrupt state in which a sheet remains inside the copying apparatus when the timing set in the first step is reached; and a third step for (a) discharging said remaining sheet and then turning off the power source of the copying apparatus immediately regardless of whether or not the timing means to operate the automatic reset function is currently counting when the judgment result in the second step determines an operation interrupt state of the copying apparatus exist, (b) turning off the power source of the copying apparatus after the completion of the automatic reset operation when the judgment result in the second step determines an operation interrupt state of the copying apparatus does not exist and the timing means is currently counting, and (c) turning off the power source of the copying apparatus immediately when the judgement result in the second step determines an operation interrupt state of the copying apparatus does not exist and the timing means is not currently counting.

* * * * *